US008562096B2

(12) United States Patent
Kimura et al.

(10) Patent No.: US 8,562,096 B2
(45) Date of Patent: Oct. 22, 2013

(54) IMAGE FORMING APPARATUS, IMAGE FORMATION METHOD, AND COMPUTER-READABLE MEDIUM

(75) Inventors: Tomonori Kimura, Kanagawa-ken (JP); Yasuo Sakurai, Kanagawa-ken (JP); Yuichi Sakurada, Kanagawa-ken (JP); Arata Suzuki, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 290 days.

(21) Appl. No.: 12/926,486

(22) Filed: Nov. 22, 2010

(65) Prior Publication Data

US 2011/0122184 A1 May 26, 2011

(30) Foreign Application Priority Data

Nov. 24, 2009 (JP) ..... 2009-266332
Apr. 19, 2010 (JP) ..... 2010-095941

(51) Int. Cl.
*B41J 29/38* (2006.01)
*B41J 29/393* (2006.01)
*B41J 2/015* (2006.01)

(52) U.S. Cl.
USPC ..... 347/14; 347/19; 347/20

(58) Field of Classification Search
USPC ..... 347/14, 20, 19, 29
See application file for complete search history.

(56) References Cited

U.S. PATENT DOCUMENTS 5,907,334 A * 5/1999 Hirano et al. ..... 347/23
2006/0268043 A1* 11/2006 Akiyama ..... 347/19
2007/0085875 A1* 4/2007 Shimazaki et al. ..... 347/32
2009/0025093 A1 1/2009 Kimura
2009/0316164 A1 12/2009 Takahashi et al.

FOREIGN PATENT DOCUMENTS

JP 2785031 5/1998
JP 2009-029037 2/2009
JP 2008-143031 6/2010

OTHER PUBLICATIONS

Abstract of JP 02-001327 published on Jan. 5, 1990.

* cited by examiner

*Primary Examiner* — Jason Uhlenhake
(74) *Attorney, Agent, or Firm* — Harness, Dickey & Pierce, P.L.C.

(57) ABSTRACT

An image forming apparatus including a first carriage having a print head independently movable in a main scanning direction, a second carriage having a print head movable with the first carriage, an encoder sheet, first and second home position reference units provided to the first and second carriages, a home position detector that detects the first and second home position reference units, and first and second position detectors provided to the first and second carriages, which detect positions of the first and second carriages by reading the encoder sheet. A control unit controls ejection of ink from the print head of the first carriage based on an output from the first position detector, and ejection of ink from the print head of the second carriage based on the output from the second position detector.

11 Claims, 12 Drawing Sheets

IMAGE FORMING APPARATUS, IMAGE FORMATION METHOD, AND COMPUTER-READABLE MEDIUM

BACKGROUND OF THE INVENTION

1. Field of the Invention

The present invention relates to an image forming apparatus, and more particularly to an ink jet image forming apparatus.

2. Discussion of the Background

Among image forming apparatuses such as printers, facsimile machines, photocopying machines, and multi-function machines thereof, there is an image faulting apparatus employing an ink jet system using a liquid ejection head that ejects droplets of recording liquid (i.e., ink) onto a transfer medium for image formation.

For example, in a printer employing a color ink jet system, images are printed by scanning by a carriage having liquid ejection heads (also referred to as a recording head, print head, or head) or heads having nozzle arrays for black (K), yellow (Y), cyan (C), and magenta (M) ink.

However, when monochrome images are printed in such color printers, the printing surfaces of the other multiple color heads which are not used for the monochrome printing are exposed to the atmosphere, causing clogging due to adhesion of dried ink or impurities to the print heads and thereby preventing the color print heads from ejecting ink properly when color images are printed after the monochrome printing.

Therefore, the color print heads have to be cleaned, which means such things as maintenance ejection of the color ink is required for the other multiple color print heads even when monochrome images are printed. However, this cleaning does consume ink. In addition, electricity is wasted and printing time is unnecessarily increasing. Furthermore, when the cleaning is insufficient, the ink is not properly ejected, resulting in degradation of image quality.

To deal with these problems, for example, Japanese patent application publication no. H02-1327-A describes a system having a first carriage for color print heads and a second carriage for monochrome print heads. The two carriages are combined by a binding mechanism for scanning and printing when printing color images. Only the second carriage scans and prints images when printing monochrome images in order to prevent the print heads on the first carriage from being exposed and drying out.

However, in the approach described in H02-1327-A two separate carriages are detachably attachable to each other, and combined as needed to scan and print images. Therefore, misalignment of the two carriages may occur, leading to degradation of image quality. Despite this problem, however, H02-1327-A does not discuss either the misalignment of the combined carriages or any solution thereto.

SUMMARY OF THE INVENTION

For these reasons, the present inventors recognize that a need exists for an image forming apparatus that has a structure of two carriages detachably attachable to each other without misalignment to reliably provide printed images of consistently high quality.

Accordingly, an object of the present invention is to provide an image forming apparatus that has a structure of two carriages detachably attachable to each other without misalignment to reliably provide printed images of consistently high quality.

Briefly, this and other objects of the present invention as hereinafter described will become more readily apparent and can be attained, either individually or in combination thereof, by an image forming apparatus including a first carriage having a print head that is independently movable in a main scanning direction, a second carriage having a print head integrally movable in the main scanning direction together with the first carriage, an encoder sheet for detecting positions of the first carriage and the second carriage in the main scanning direction, a first home position reference unit provided to the first carriage, a second home position reference unit provided to the second carriage, a home position detector that detects the first home position reference unit and the second home position reference unit, a first position detector provided to the first carriage that detects a position of the first carriage by reading the encoder sheet, a second position detector provided to the second carriage that detects a position of the second carriage by reading the encoder sheet, and a control unit including a central processing unit that controls ejection of ink from the print head of the first carriage based on an output from the first position detector when the home position detector detects the first home position reference unit, and ejection of ink from the print head of the second carriage based on the output from the second position detector when the home position detector detects the second home position reference unit.

It is preferred that, in the image forming apparatus described above, when images are printed by singly moving the first carriage, the first carriage and the second carriage are coupled together and pressed against a stopper provided on a lateral side of the apparatus until outputs of the first position detector and the second position detector are unchanged, and thereafter the outputs of the first position detector and the second position detector are reset, the first carriage is singly moved to a printable area, and a printing position of the first carriage is initialized when the home position detector detects the first home position reference unit.

It is still further preferred that, in the image forming apparatus described above, when images are printed by integrally moving the first carriage and the second carriage together, the first carriage and the second carriage are coupled together and pressed against a stopper provided on a lateral side of the apparatus until outputs of the first position detector and the second position detector are unchanged, thereafter the outputs of the first position detector and the second position detector are reset, the first carriage and the second carriage are integrally moved to a printable area, a printing position of the first carriage is initialized when the home position detector detects the first home position reference unit, and a printing position of the second carriage is initialized when the home position detector detects the second home position reference unit.

It is still further preferred that, in the image forming apparatus described above, one of the first carriage and the second carriage further includes a relative position encoder sheet that detects a position in the main scanning direction, and the other of the first carriage and the second carriage further includes a third position detector that reads the relative position of the encoder sheet, and wherein a relative tilt between the first carriage and the second carriage is detected based on outputs of the first position detector, the second position detector, and the third position detector.

It is still further preferred that, in the image forming apparatus described above, printing positions are corrected based on the relative tilt between the first carriage and the second carriage.

As another aspect of the present invention, an image formation method is provided which includes moving a first carriage having a print head in a main scanning direction, moving a second carriage having a print head integrally in the main scanning direction together with the first carriage, detecting the positions of the first carriage and the second carriage in the main scanning direction by reading an encoder sheet by a first position detector provided to the first carriage, and a second position detector provided to the second carriage, respectively, detecting a first home position reference unit provided to the first carriage and a second home position reference unit provided to the second carriage by a home position detector and controlling ejection of ink from the print head of the first carriage based on an output from the first position detector when the home position detector detects the first home position reference unit and ejection of ink from the print head of the second carriage based on an output from the second position detector when the home position detector detects the second home position reference unit by control unit including a central processing unit.

As another aspect of the present invention, a computer-readable recording medium storing a computer program for executing a control method for a recording device is provided, the control method including moving a first carriage comprising a print head in a main scanning direction;

moving a second carriage comprising a print head integrally in the main scanning direction together with the first carriage;

detecting positions of the first carriage and the second carriage in the main scanning direction by reading an encoder sheet by a first position detector provided to the first carriage, and a second position detector provided to the second carriage, respectively;

detecting a first home position reference unit provided to the first carriage and a second home position reference unit provided to the second carriage by a home position detector; and controlling ejection of ink from the print head of the first carriage based on an output from the first position detector when the home position detector detects the first home position reference unit and ejection of ink from the print head of the second carriage based on an output from the second position detector when the home position detector detects the second home position reference unit by control unit comprising a central processing unit.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE PRESENT DISCLOSURE

The structure of embodiments of the present disclosure is described with reference to the accompanied drawings. In this specification, the term "medium" is not limited to paper, and may be also referred to as a recording medium, transfer material, or recording paper. In addition, the term "image formation" includes recording, printing, and imaging.

In sum, the image forming apparatus of the present disclosure includes a first carriage 5*a* independently movable in a main scanning direction, and a second carriage integrally movable in the main scanning direction together with the first carriage 5*a*. In addition, the image forming apparatus further includes an encoder sheet 32 that is used to detect the positions of the first carriage 5*a* and the second carriage 5*b* in the main scanning direction, a first home position reference unit (closure plate 34*a*) that is attached to the first carriage 5*a*, a second home position reference unit (closure plate 34*b*) that is attached to the second carriage 5*b*, a home position detector (home position sensor 35) that detects the first home position reference unit and the second home position reference unit, a first position detector (first position detection sensor 33*a* and a first position counter 112*a*) that is provided to the first carriage 5*a* to detect the position of the first carriage 5*a* by reading the encoder sheet 32, and a second position detector (second position detection sensor 33*b* and a second position counter 112*b*) that is provided to the second carriage 5*b* to detect the position of the second carriage 5*b* by reading the encoder sheet 32. A control unit 100 (shown in functional block form in FIG. 3) in the image forming apparatus controls ink ejection from the print head installed onto the first carriage 5*a* based on the output from the first position detector when the home position detector detects the first home position reference unit, and from the print head installed onto the second carriage 5*b* based on the output from the second position detector when the home position detector detects the second home position reference unit.

A description is now given of specific embodiments of the present invention.

First Embodiment

Structure of the Image Forming Apparatus

Figure 1:
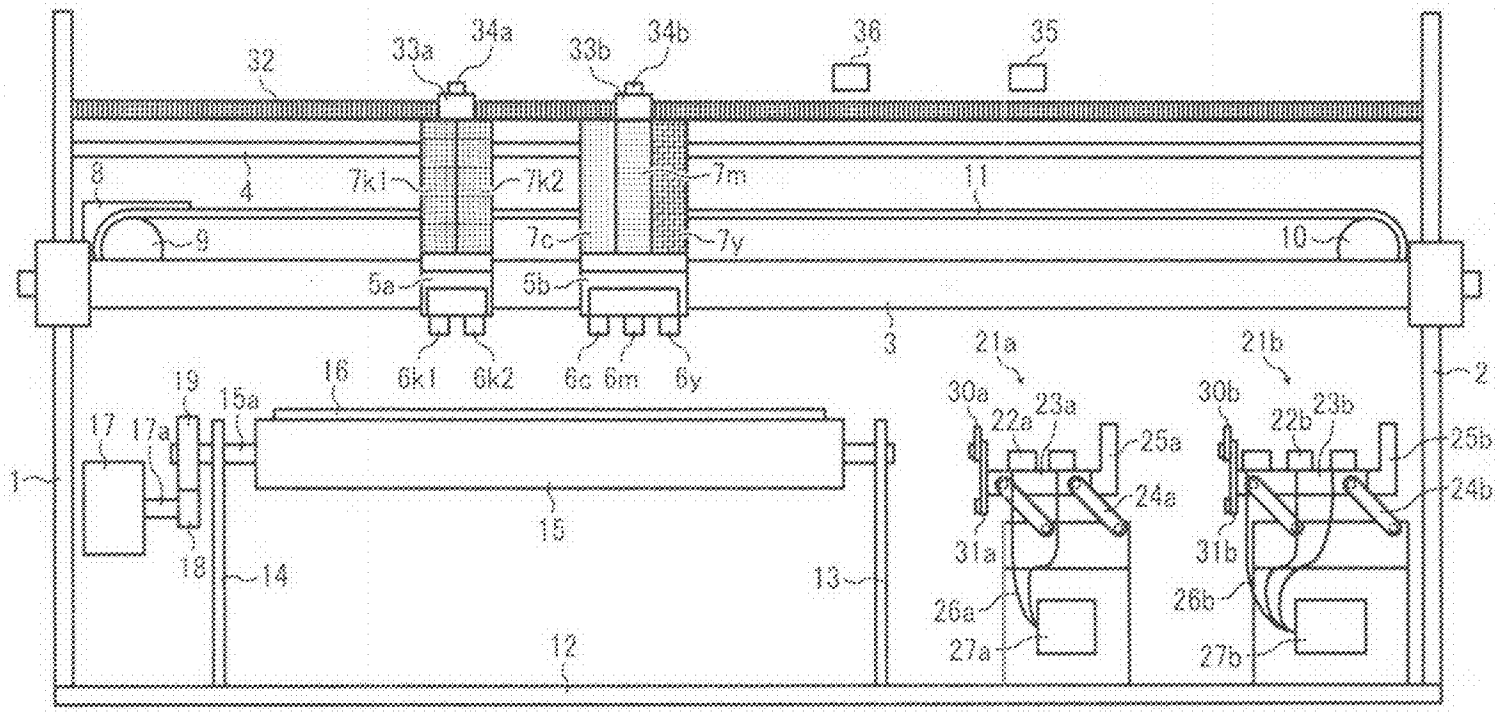
FIG. 1 is a schematic diagram illustrating the mechanism part of an embodiment of the image forming apparatus of the present disclosure.

FIG. 1 is a schematic structure view illustrating the mechanism portion of the ink jet recording apparatus.

In the mechanism of this ink jet recording apparatus, a main support guide rod 3 and a sub-support guide rod 4 extend substantially horizontal to each other between side plates (left side plate 1 and right side plate 2) situated on both sides to support the first carriage 5*a* for monochrome printing and the second carriage 5*b* for color printing, such that the two carriages can slidably move along the rods in the main scanning direction. In this embodiment, the right side plate 2 is used as a stopper against which the carriages are pressed. In addition, the encoder sheet 32 for position detection is provided all over the entire movable area of the first carriage 5*a* and the second carriage 5*b* between the side plates 1 and 2. In this embodiment, the encoder sheet 32 is a sheet having a stripe pattern with a unit corresponding to the print resolution. However, the encoder sheet 32 is not limited thereto, and any known or new encoder sheet can be used.

In addition, any known method can be used for the sensor control to obtain the position information by reading the encoder sheet, and thus a description of such methods is omitted.

The first carriage 5*a* includes two print heads 6*k*1 and 6*k*2 that eject black ink, with their ejection surfaces (nozzle surfaces) downward. In addition, the first carriage 5*a* has replaceable ink cartridges 7*k*1 and 7*k*2 as ink suppliers to supply ink to the print heads 6*k*1 and 6*k*2, respectively, above a print head 6*a* for monochrome printing. In this specification, the print head 6*a* is used to indicate the print heads 6*k*1 and 6*k*2 when the latter are referred to collectively.

The first carriage 5*a* further includes the first carriage sensor 33*a* that obtains the position information of the first carriage 5*a* by reading the encoder sheet 32, and the closure plate (first home position reference unit) 34*a* detected by the home position sensor 35 so that the control unit 100 detects the home position the first carriage 5*a*.

Although the home position reference unit in this embodiment is the closure plate 34*a* that is detected by the home position 35, the home position reference unit is not limited thereto. Alternatively, for example, a combination of a light-emitting unit provided to a carriage and a sensor having a light-receiving unit can be suitably used.

The second carriage 5*b* includes three print heads 6*c*, 6*m*, and 6*y* that eject cyan (C) ink, magenta (M) ink, and yellow (Y) ink, respectively, with their ejection surfaces (nozzle surfaces) downward. In addition, the second carriage 5*b* has three replaceable ink cartridges 7*c*, 7*m*, and 7*y* as ink suppliers to supply corresponding ink to the print heads 6*c*, 6*m*, and 6*y*, respectively provided above a print head 6*b* (=the print heads 6*c*, 6*m*, and 6*y*) for color printing.

The second carriage 5*b* further includes the second carriage sensor 33*b* that obtains the position information of the second carriage 5*b* by reading the encoder sheet 32, and the closure plate (second home position reference unit) 34*b* detected by the home position sensor 35 so that the control unit 100 detects the home position of the second carriage 5*b*.

The positions detected by the home position sensor 35 when the closure plates 34*a* and 34*b* provided to the first carriage 5*a* and the second carriage 5*b*, respectively, are detected are determined as the home positions of the respective carriages.

In addition, an entry sensor 36 of the printing area is provided at the boundary with the printing area in the main scanning direction to detect whether the carriages 5*a* and 5*b* are present in the printing area.

In this embodiment, the print head 6*k*1 is set as the reference head (monochrome reference head) marking the reference position of the first carriage 5*a*, and the print head 6*c* is set as the reference head (color reference head) marking the reference position of the second carriage 5*b*. The positional relationship (e.g., a distance) between the assembly position of the print head 6*k*1 and the encoder sheet 32 is determined as the same as the positional relationship (e.g., a distance) between the assembly position of the print head 6*c* and the encoder sheets 32.

In addition, the first carriage 5*a* is connected to a timing belt 11 suspended between a driving pulley (driving timing pulley) 9 rotated by a main scanning motor 8 and a idler pulley 10 to move the print head 6*a* of the first carriage 5*a* along the main scanning direction by controlling driving of the main scanning motor 8.

Figure 2:
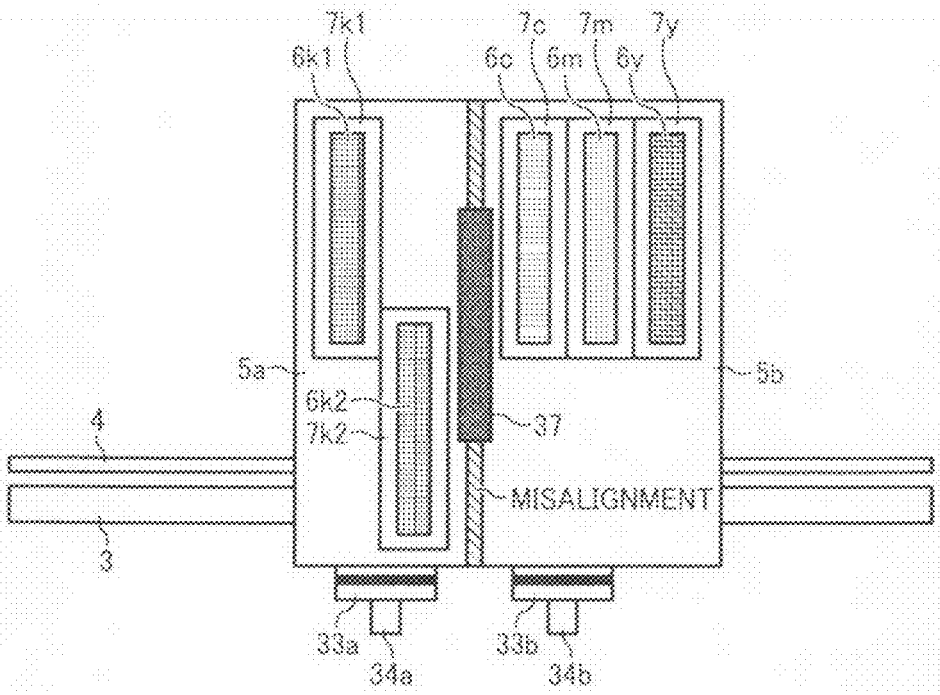
FIG. 2 is a schematic diagram illustrating a first carriage and a second carriage connected by a lock mechanism.

In addition, as illustrated in FIG. 2, the first carriage 5*a* and the second carriage 5*b* are coupled by a lock mechanism (linking device) 37. The print head 6*b* of the second carriage 5*b* moves in the main scanning direction driven by the first carriage 5*a*. There is no specific limit to the selection of the lock mechanism 37. For example, a linking lever and an engagement pin are suitable.

In addition, sub-frames 13 and 14 are vertically arranged on a base plate 12 that connects the side plates 1 and 2, and supports a transfer roller 15 that feeds a sheet 16 between the sub-frames 13 and 14 in a sub-scanning direction perpendicular to the main scanning direction by rotation.

A sub-scanning motor 17 is provided on the lateral side of the sub-frame 14. A gear 18 fixed to a rotation axis 17*a* of the sub-scanning motor 17 and a gear 19 fixed to an axis 15*a* of the transfer roller 15 are provided to transmit the torque from the sub-scanning motor 17 to the transfer roller 15.

Furthermore, a sub-system (also referred to as a cleaning device) 21*a* for the print head 6*a* for monochrome printing, and a sub-system 21*b* for the print head 6*b* for color printing are provided between the side plate 2 and the sub-frame 13.

The sub-system 21*a* of the print head 6*a* for monochrome printing has a holder 23*a* supporting two capping devices 22*a* that cap the ejection surface of the print head 6*a*. The holder 23*a* is supported by a link member 24*a* so as to swing back and forth. The first carriage 5*a* contacts an engaging portion 25*a* provided to the holder 23*a* when the first carriage 5*a* moves in the main scanning direction. Therefore, as the first carriage 5*a* moves in the main scanning direction, the holder 23*a* is lifted so that the ejection surface of the print head 6*a* is capped by the capping device 22*a*. As the first carriage 5*a* moves towards the printing area, the holder 23*a* lifts down so that the capping device 22*a* moves away from the ejection surface of the print head 6*a*.

The capping device 22*a* is connected to a suction pump 27*a* via a suction tube 26*a*, forms an air releasing opening and is communicated with atmosphere via an air releasing tube, and an air releasing valve.

In addition, the suction pump 27*a* discharges waste liquid (ink) suctioned by the suction pump 27*a* to a waste liquid tank through a drain tube, etc.

Furthermore, on the lateral side of the holder 23*a*, a wiper blade 30*a* serving as wiping device formed of an elastic material such as fiber, foamed material, and rubber that wipes the discharging surface of the print head 6*a* is attached to a blade arm 31*a*. The blade arm 31*a* is pivotally supported to swing back and forth by the rotation of cams rotated by a driving device (not shown).

The sub-system 21*b* for the print head 6*b* for color printing has the same structure as the subs-system 21*a* that includes three capping devices 22*b* that cap the ejection surface of the print head 6*b*, a holder 23*b*, a linking member 24*b*, an engaging portion 25*b*, a suction tube 26*b*, a suction pump 27*b*, a wiper blade 30*b*, and a blade arm 31*b*.

According to the image forming apparatus of the embodiment structured as described above, a monochrome image is recorded on the sheet 16 by ejecting ink droplets from each print head of 6*k*1 and 6*k*2 while moving the first carriage 5*a* having the print head 6*a* for scanning in the main scanning direction and simultaneously transferring the sheet 16 in the sub-scanning direction.

In the case of color printing, a color image is recorded on the sheet 16 by ejecting ink droplets from the nozzles of each print head of 6*k*1, 6*k*2, 6*y*, 6*m*, and 6*c* for required colors while moving the first carriage 5*a* coupled with the second carriage 6*s* having the print head 6*b* for color printing by the lock mechanism 37 for scanning in the main scanning direction and simultaneously transferring the sheet 16 in the sub-scanning direction.

Configuration of the Control Unit

Figure 3:
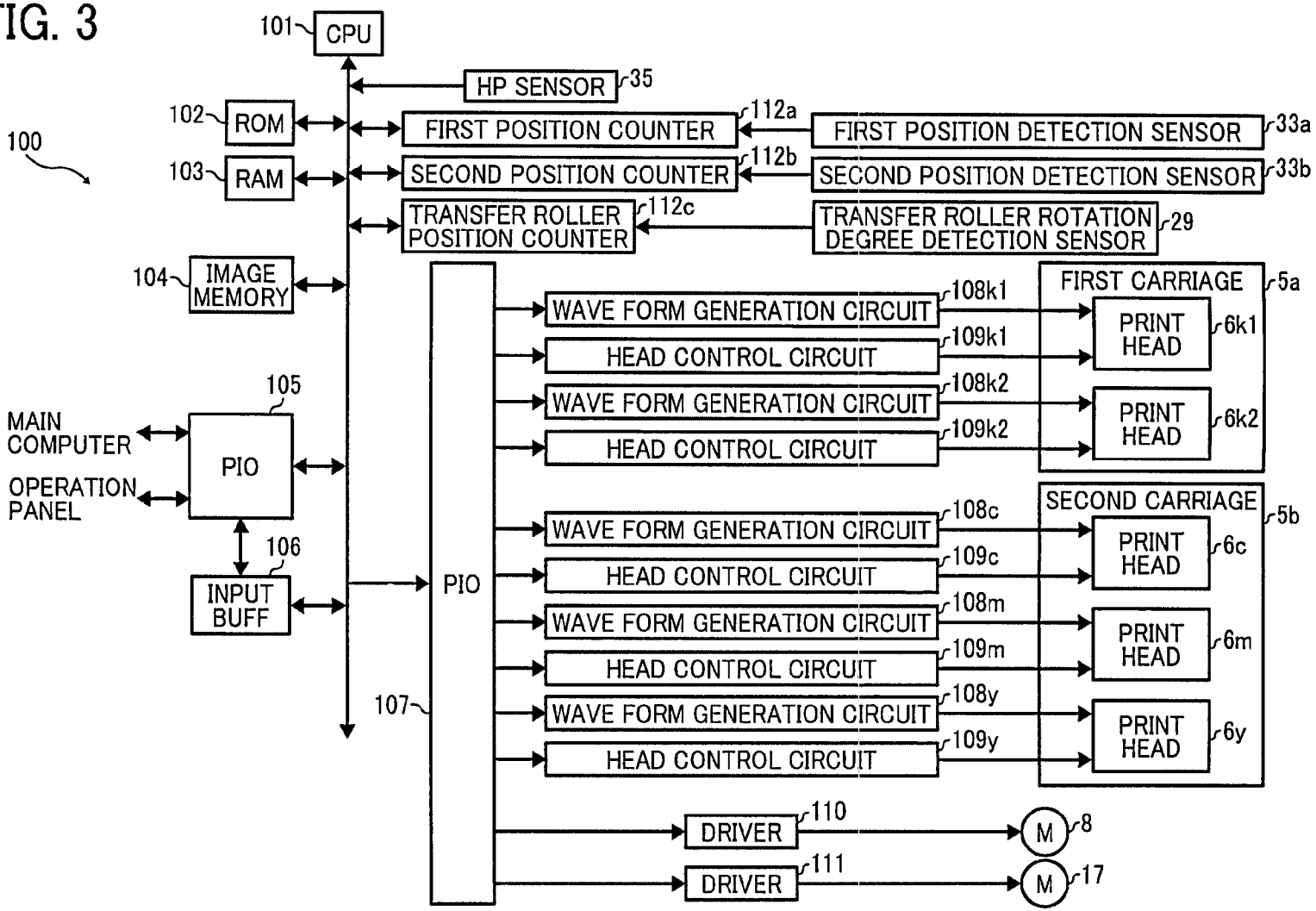
FIG. 3 is a function block diagram of a control unit of an embodiment of the image forming apparatus of the present disclosure.

FIG. 3 is a function block diagram illustrating a control system (control unit) 100 of the image forming apparatus of this embodiment.

The control unit 100 includes a microcomputer (CPU) 101 that exerts overall control of the image forming apparatus as the driving control device, a ROM 102 that stores certain predetermined, fixed data, a RAM used as a working memory, etc., an image memory 104 that stores processed image data transferred from the main computer, a parallel input output port (PIO) 105 that performs parallel input output from devices on the upstream side such as the main computer, an input buffer 106, a parallel input-output port (PIO) 107 that performs input and output to and from external devices on the downstream side, a waveform generation circuit 108 that generates a driving waveform required to drive analog elements of each print head, a head control circuit 109 that generates control signals to control each print head, a first motor driver 110 that drives the main scanning motor 8, and a second motor driver 111 that drives the sub-scanning motor 17 that drives the transfer roller 15 in the sub-scanning direction, and other driving power sources.

Various kinds of information, such as image data from the main computer, various kinds of instructions such as cleaning instructions from the operation panel, detection signals indicating detection of the front end and the rear end of a sheet from a sheet detection sensor, and signals from each kind of sensor such as the home position sensor 38 that senses the closure plate 34*a* of the first carriage 5*a*, are input to the parallel input output port 107. In addition, the parallel input output port 107 sends out required information to the main computer and the operation panel via the parallel input output port 105 on the upstream side.

In addition, a first carriage counter (first carriage position counter) 112*a* is provided that processes inputs of A phase of the first position detection sensor 33*a* provided to the first carriage 5*a*, and B phase having a phase 90 degree shifted from A phase, and detects the position of the first carriage 5*a* by a resolution power of quadrupled frequency relative to the resolution power of each phase.

Furthermore, there are also provided a second position counter (second carriage position counter) 112*b* having a similar function to the first position counter, and a transfer roller position counter 112*c* provided for a transfer roller rotation angle detection sensor 29 provided to the transfer roller 15.

The waveform generation circuit 108 generates and outputs a driving waveform that is applied to a piezoelectric element in the print head. In this embodiment, a D/A converter is used as the waveform generation circuit 108 to generate and output a first driving waveform to form large dots, a second driving waveform to form small dots, and a third driving waveform to form minute dots by D/A conversion of the voltage data provided from the CPU 101. In addition, since the waveform generation circuit 108*k*1, 108*k*2, 108*c*, 108*m*, and 108*y* (referred to collectively as waveform generation circuit 108) is provided for each print head, driving waveforms can be generated separately at a specific timing for each individual print head.

Based on various kinds of data and signals provided via the parallel input output port 107 on the downstream side, a head control circuit 109*k*1, 109*k*2, 109*c*, 109*m*, and 109*y* (referred to collectively as head control circuit 109) controls the print heads by generating signals required to control the print heads such as application of a driving waveform output by the waveform generation circuit 108 for the piezoelectric elements corresponding to respective nozzles of the print head, and transferring of image data output from the image memory 104 by the CPU 101 to each nozzle.

The motor driver 110 and the driver 111 move the first carriage 5*a* for scanning in the main scanning direction to rotate the transfer roller 15 and transfer the sheet 16 with a predetermined amount by driving and controlling the main scanning motor 8 and the sub-scanning motor 17 according to the driving data provided via the parallel input output port 107 on the downstream side.

Carriage Misalignment

Figure 4:
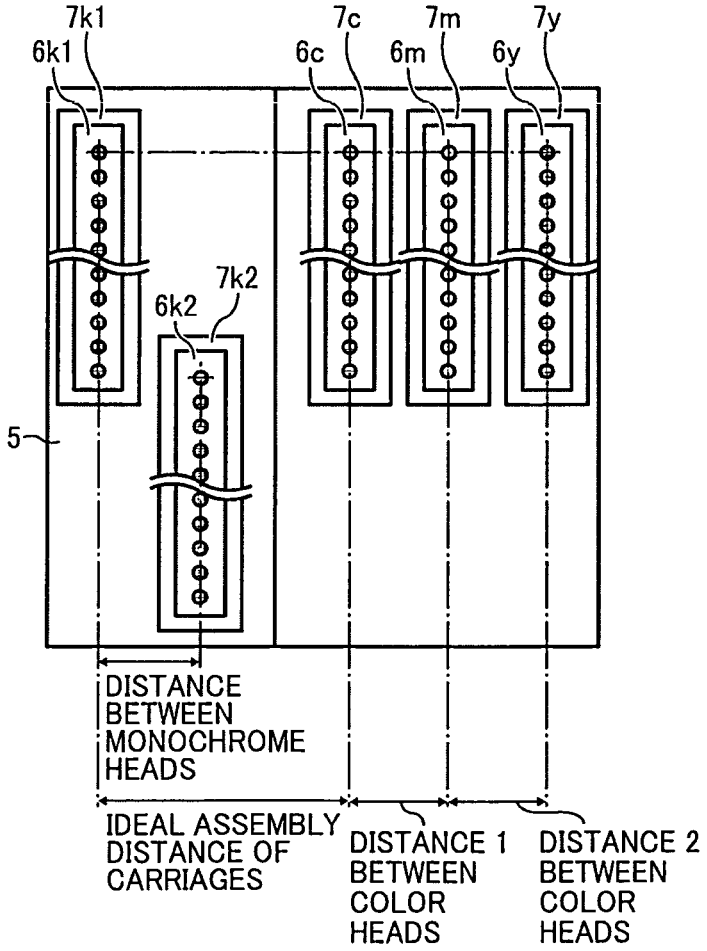
FIG. 4 BACKGROUND ART
FIG. 4 is a schematic diagram illustrating a typical integrated carriage.

As illustrated in FIG. 4, conventionally, the theoretical relative assembly distance between each print head and the reference head, i.e., the monochrome print head 6*k*1, is fixed in an integrated carriage 5 having print heads for both monochrome and color ink. Therefore, images are printed by adjusting the print timing with the pixel unit corresponding to the highest resolution power of the encoder based on the carriage speed at printing and the theoretical relative assembly distance.

Figure 5:
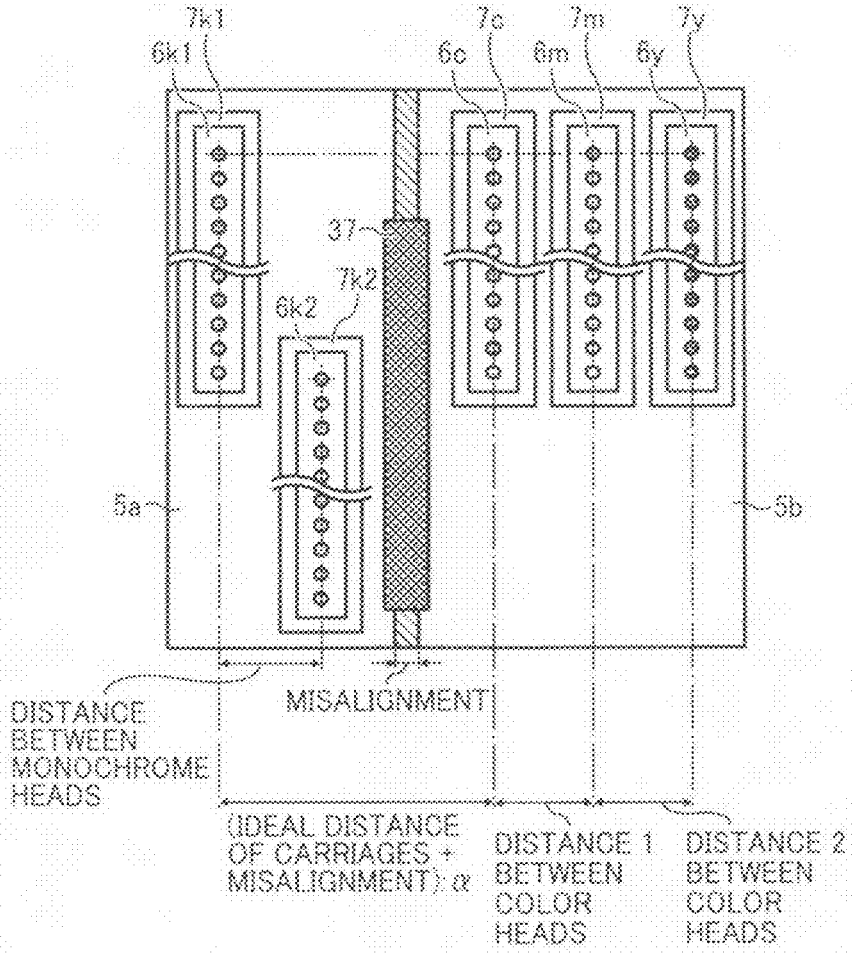
FIG. 5 is a diagram illustrating the combined state of the first and the second carriages.

The distance between the monochrome print heads in FIGS. 4 and 5 is the assembly distance between the print head 6*k*1 and the print head 6*k*2. A color print head distance 1 is the assembly distance between the print head 6*c* and the print head 6*m*. A color print head distance 2 is the assembly distance between the print head 6*m* and the print head 6*y*. The theoretical ideal assembly distance between the carriages is the assembly distance between the print head 6*k*1 and the print head 6*c*.

However, as illustrated in FIG. 5, in the image forming apparatus of this embodiment the first carriage 5*a* for monochrome printing and the second carriage 5*b* for color printing are coupled and also separated by the lock mechanism 37. If color printing is conducted by linking the first carriage 5*a* and the second carriage 5*b* having a structure in which the cleaning process such as capping on the sub-system 22 is performed for the second carriage 5*b* in the case of monochrome printing, misalignment occurs between the carriages 5*a* and 5*b*. That is, this misalignment is added to the theoretical ideal distance between the carriages, with the result that the ink may not land on the desired position on the recording medium.

Therefore, the image forming apparatus related to this embodiment is to reduce occurrence of inexact printing (i.e., ejected ink lands away from the desired position) ascribable to the misalignment. Outputs from the first position detection sensor 33*a* and the second position detection sensor 33*b* attached to the first carriage 5*a* and the second carriage 5*b*, respectively, are read out as unique to each of the two carriages. In addition, by having the first position counter 112*a*, and the second position counter 112*b* for counting up and down, the absolute position of each carriage in the main scanning direction can be obtained. Each carriage independently has a print position system (distance from the home position) so that each of the first carriage 5*a* and the second carriage 5*b* prints dots at a position determined based on this print position system for the position required by the control unit 100. Therefore, images are printed without an impact caused by the misalignment that occurs when the first carriage 5*a* and the second carriage 5*b* are coupled. Therefore, it is possible to prevent the occurrence of the shift between the print position when the first carriage singly scans for monochrome printing and the position when the first carriage 5*a* and the second carriage 5*b* scan together for color printing.

Image Formation Method

Print Initial Setting

The print processing (image formation method) of the image forming apparatus in this embodiment is described below.

Figure 6:
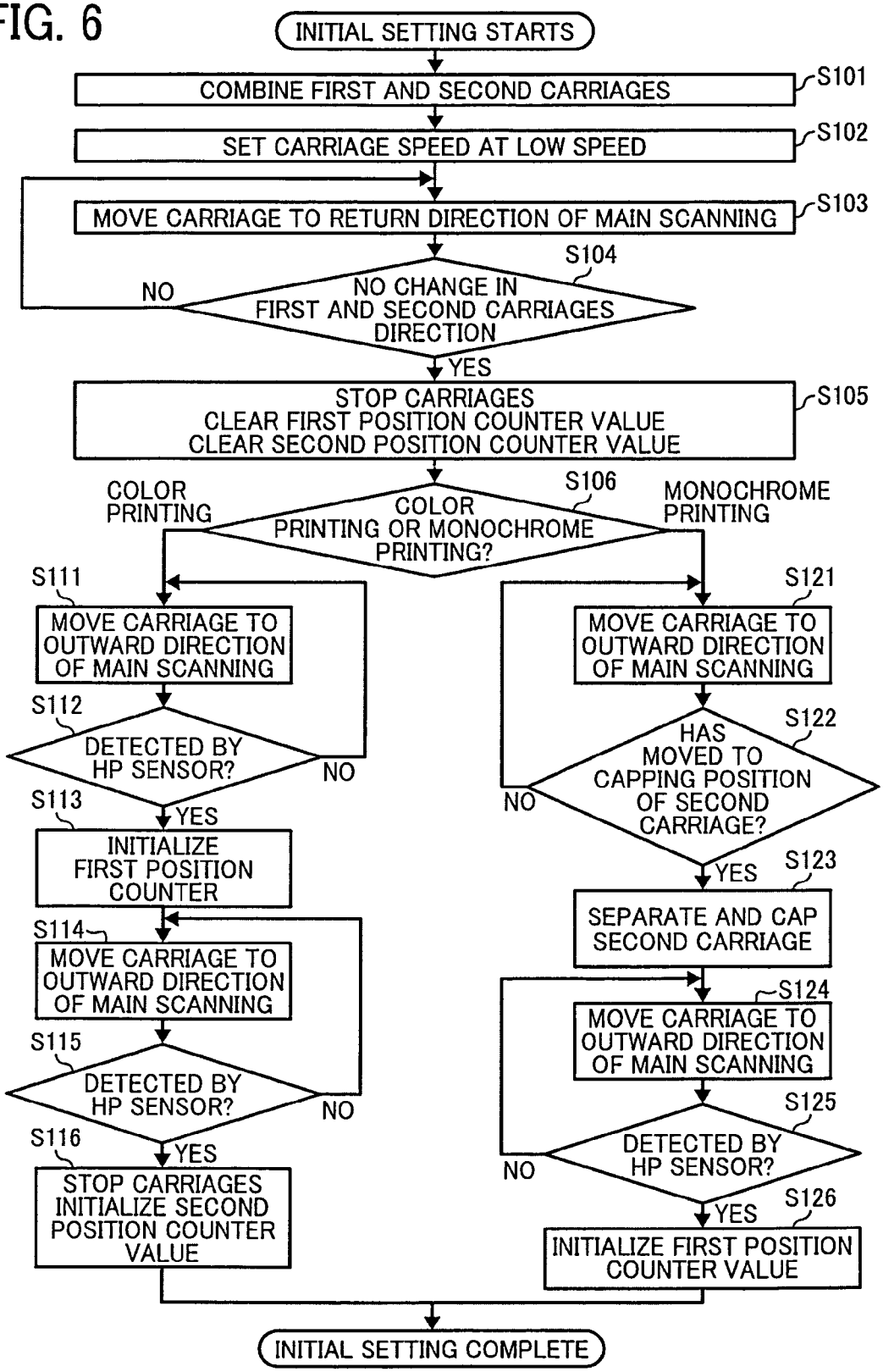
FIG. 6 is a flow chart illustrating the start of printing in the printing processing.

FIG. 6 is a flow chart illustrating the initial printing behavior in the print processing.

First, capping is released and the first carriage 5*a* and the second carriage 5*b* (S101) are combined; After linking the carriages, the linked carriages 5*a* and 5*b* are moved in the return direction (right direction in FIG. 1) at a predetermined speed not to damage the apparatus; the first carriage 5*a* and the second carriage 5*b* are moved until both of the position counter values of the position counters 112*a* and 112*b* for the first carriage 5*a* and the second carriage 5*b* are unchanged (S102 to S104); The state in which the counter value does not change is that the combined first carriage 5*a* and the second carriage 5*b* are pressed against the side plate 2; The counter values of the first position counter 112*a* and the second position counter 112*b* are reset in the state in which the combined first carriage 5*a* and the second carriage 5*b* are pressed against the side plate 2 (S105); and when printing is determined as monochrome printing (S106: monochrome printing), the combined carriages 5*a* and 5*b* are moved to the position where the second carriage 5*b* is capped after clearing the counter values of the position counters, the second carriage 5*b* is separated at the capping position and capped (S121 to S123).

Normally, with regard to the capping positioning, the difference caused by such as misalignment is within the tolerable range, which does not affect the operation.

Next, when only the first carriage 5*a* is moved in the outward direction (left direction in FIG. 1), the position detection sensor 33*a* detects the encoder sheet and outputs signals; the first position counter 112*a* starts counting the signals output by the first detection sensor 33*a* based on detection of the encoder sheet; The counter value of the first position counter 112*a* at the time when the closure plate 34*a* is detected by the home position sensor (HP sensor) 35 (S125) is written as the offset value and the first position counter 112*a* is initialized (S126); and The offset value is written, for example, a register of the first position counter 112*a*.

The position counter for each carriage can count down in the minus direction from the initial value when the power is turned on and the carriage is moved in the outward direction.

On the other hand, when printing is determined as color printing (S106: color printing) and the first carriage 5*a* and the second carriage 5*b* start moving, the first position detection sensor 33*a* and the second position detection sensor 33*b* detect the encoder sheet and output signals; Simultaneously, the first position counter 112*a* and the second position counter 112*b* start counting the signals output by the first position detection sensor 33*a* and the second position detection sensor 33*b* (S111); The counter value of the first position counter 112*a* is written as the offset value of the first carriage 5*a* at the time when the home position sensor 35 detects the closure plate 34*a* (S112); the first position counter 112*a* is initialized (S113); the carriage 5*a* is moved furthermore (S114); The counter value of the second position counter 112*b* is written as the offset value of the second carriage 5*b* at the time when the home position sensor 35 detects the closure plate 34*b* (S115); and the second position counter 112*b* is initialized (S116).

After initialization of each position counter, each printing position system is established for each carriage. Therefore, the carriages can be stopped at any arbitrary position.

The position counter for each carriage can count down in the minus direction from the initial value when the power is turned on and the carriage is moved in the outward direction.

Monochrome Printing Behavior

Next, the monochrome printing is described with reference to FIGS. 3 and 7.

As described above, by the initialization (S126) of the first position counter 112*a* of the first carriage 5*a* in the initialization behavior, the control unit 100 recognizes the monochrome head printing position system relative to the first carriage 5*a*.

Figure 7:
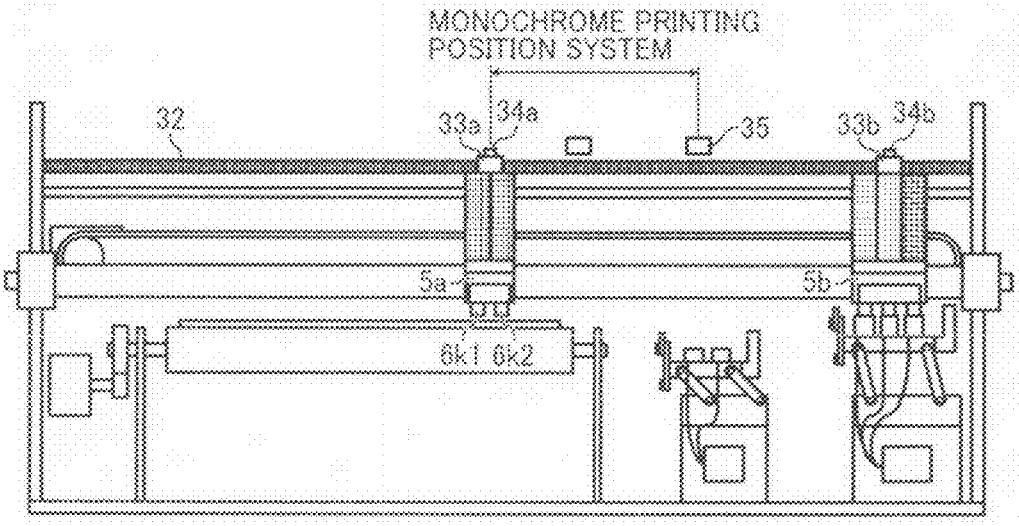
FIG. 7 is a schematic diagram illustrating the image forming apparatus of the present disclosure when printing monochrome images.

In this state, in the case of monochrome printing, as illustrated in FIG. 7, the first carriage 5*a* and the second carriage 5*b* are separated and the second carriage 5*b* is capped. Therefore, since the maintenance operation is not necessary during monochrome printing, printing is performed by operating only the first carriage 5*a*.

In this embodiment, the monochrome reference head 6*k*1 prints dots checking the print position of the image while referring to the value (¼ unit of the position counter resolution power) counted up every time a rise of the output of A phase from the first position detection sensor 33*a* of the first carriage 5*a* is detected.

The print timing can be finely adjusted by using the value of the first position counter 112*a* of the first carriage 5*a* of quadrupled frequency.

As illustrated in FIG. 3, once the CPU 101 recognizes a position one before the position where the print head 6*k*1 starts printing an image, the CPU 101 starts reading the first data group to be printed by the print head 6*k*1 from the image memory 104, and transfers them to the print head 6*k*1 via a head control circuit 109*k*1 for the print head 6*k*1.

Then, to make a fine adjustment of the ink landing position referring to the next A phase output timing from the first position detection sensor 33*a*, the CPU 101 outputs a driving waveform from the waveform generation circuit 108*k*1 for the print head 6*k*1 at an arbitrary print timing by using the first position counter 112*a* of the first carriage 5*a*. By the head control generation circuit 109*k*1, signals and data required for the other print heads to print images are transferred to conduct the first printing operation.

At the same time, the image data to be printed at the next count position are transferred.

The print head 6*k*1 does not stop image printing until the first position counter 112*a* of the first carriage 5*a* reaches the position count at which the printing is complete by repeating this process.

In addition, as illustrated in FIG. 5, the print head 6*k*2 is assembled at a position away from the print head 6*k*1 with a distance A between the monochrome print heads. Therefore, printing is adjusted to meet the monochrome reference head 6*k*1 by starting the operation of the waveform generation circuit 108*k*2 for the head 6*k*2 and the head control circuit 109*k*2 as described above ahead of the print timing of the reference print head 6k1 with a value corresponding to the distance A for the first position counter 112*a* of the first carriage 5*a*.

Therefore, when monochrome printing is performed, the consumption of the ink and the power to maintain the print heads that are not used for printing, and the printing time can be reduced.

Color Printing Operation

Next, the color printing is described with reference to FIGS. 3 and 8.

As described above, by the initialization (S113 and S116) of the position counter 112*a* of the first carriage 5*a* and the position counter 112*b* of the second carriage 5*b* in the initialization operation, the control unit 100 recognizes the monochrome printing position system relative to the first carriage 5*a*, and the color printing position system relative to the second carriage 5*b*.

Figure 8:
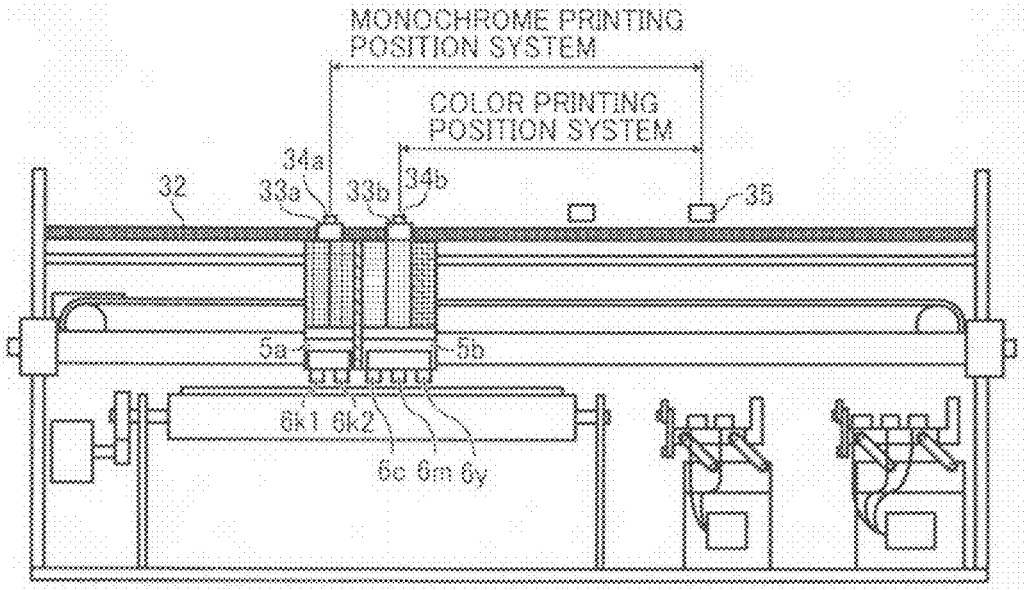
FIG. 8 is a schematic diagram illustrating the image forming apparatus of the present disclosure when printing color images.

From this initialized state, the first carriage 5*a* and the second carriage 5*b* are coupled in the case of the color printing as illustrated in FIG. 8, and then printing starts while both carriages are combined.

In this embodiment, the cyan print head 6*c* as the color reference print head prints an image checking the print position of the image while referring to the value (¼ unit of the position counter resolution power) counted up every time a rise of the output of A phase from the second position detection sensor 33*b* of the second carriage 5*b* is detected.

The printing position for color printing can be adjusted by generating the printing timing of the other color print heads 6*m* and 6*y* based on the cyan print head 6*c*.

Since the print control of the print heads for the monochrome printing is performed by using its own monochrome printing position system of the first carriage 5*a* as described above, the overlapping description is omitted.

As illustrated in FIG. 3, once the CPU 101 recognizes a position one before the position where the cyan print head 6*c* starts printing an image, the CPU 101 starts reading the first data group printed by the print head 6*c* from the image memory 104, and transfers the print head 6*c* via a head control circuit 109*c* for the print head 6*c*.

Then, to make a fine adjustment of the ink landing position referring to the next A phase output timing from the second position detection sensor 33*b*, the CPU 101 outputs a driving waveform from the waveform generation circuit 108*c* for the print head 6*c* at an arbitrary print timing by using the second position counter 112*b* of the second carriage 5*b*. By the head control generation circuit 109*c*, signals and data required for the other print heads to print images are transferred to conduct the first printing operation.

At the same time, the image data to be printed at the next count position are also transferred.

The cyan print head 6*c* does not stop image printing until the second position counter 112*b* of the second carriage 5*b* reaches the position count at which the printing is complete by repeating this process.

In addition, as illustrated in FIG. 5, the magenta print head 6*m* is assembled at a position away from the cyan print head 6*c* with a distance B (color print head distance 1) between the cyan print head and the magenta print head. Therefore, printing is adjusted to meet the color reference print head 6*c* by starting the operation of the waveform generation circuit 108*m* for the magenta print head 6*m* and the head control circuit 109*m* as described above ahead of the print timing of the cyan print head 6*c* with a value corresponding to the distance B for the second position counter 112*b* of the second carriage 5*b*.

Similarly, the magenta print head 6*m* prints an image checking the print position of the image while referring to the value (¼ unit of the position counter resolution power) counted up every time a rise of the output of A phase from the second position detection sensor 33*b* of the second carriage 5*b* is detected.

In addition, as illustrated in FIG. 5, the yellow print head 6*y* is assembled at a position away from the cyan print head 6*c* with a distance B (color print head distance 1) between the cyan print head and the magenta print head and a distance C (color print head distance 2) between the magenta print head and the yellow print head. Therefore, printing is adjusted to meet the color reference print head 6*c* by starting the operation of the waveform generation circuit 108*y* for the yellow print head 6*y* and the head control circuit 109*y* as described above ahead of the print timing of the cyan print head 6*c* with a value corresponding to the distance B and the distance C for the second position counter 112*b* of the second carriage 5*b*.

Similarly, the yellow print head 6*y* prints an image checking the print position of the image while referring to the value (¼ unit of the position counter resolution power) counted up every time a rise of the output of A phase from the second position detection sensor 33*b* of the second carriage 5*b* is detected.

As described above, since the first carriage 5*a* and the second carriage 5*b* in the image forming apparatus related to this embodiment have the position counters 112*a* and 112*b*, respectively, which are initialized separately to have each print position system, the second carriage 5*b* can print images by referring to value of its own second position counter 112*b* without adjusting the timing considering the amount corresponding to the misalignment in the case of the color printing.

For example, when the monochrome print head 6k1 prints dots at the position n (n represents any integer) in the main scanning, the first position counter 112*a* of the first carriage 5*a* prints dots in the range of the encoder decomposition when the first position counter 112*a* of the first carriage 5*a* reaches the count n. To print dots by the cyan print head 6*c* at the same position, it is suitable to start printing when the second position counter 112*b* of the second carriage 5*b* reaches the count n. With regard to the other print heads, it is suitable to start printing by shifting the timing considering the assembled position of each print head relative to each carriage reference print head.

Thus, the occurrence of the print position shift between the monochrome printing position and the color printing position caused by the misalignment of the first carriage and the second carriage can be reduced.

Second Embodiment

Another (Second) embodiment of the image forming apparatus of the present disclosure is described next with reference to FIGS. 9 to 13.

In this embodiment of the image forming apparatus of the present disclosure, in addition to the structure described above, a relative position encoder sheet 40 is provided to one of the first carriage 5*a* and the second carriage 5*b*, and a third position detector (a third position detection sensor 41 and a third position counter 42) is provided to the other of the two carriages. Based on the outputs from the first position detector, the second position detector, and the third position detector, the relative tilt between the first carriage 5*a* and the second carriage 5*b* is detected.

The overlapping description between the first and the second embodiments is omitted.

Structure of Image Forming Apparatus

Figure 9:
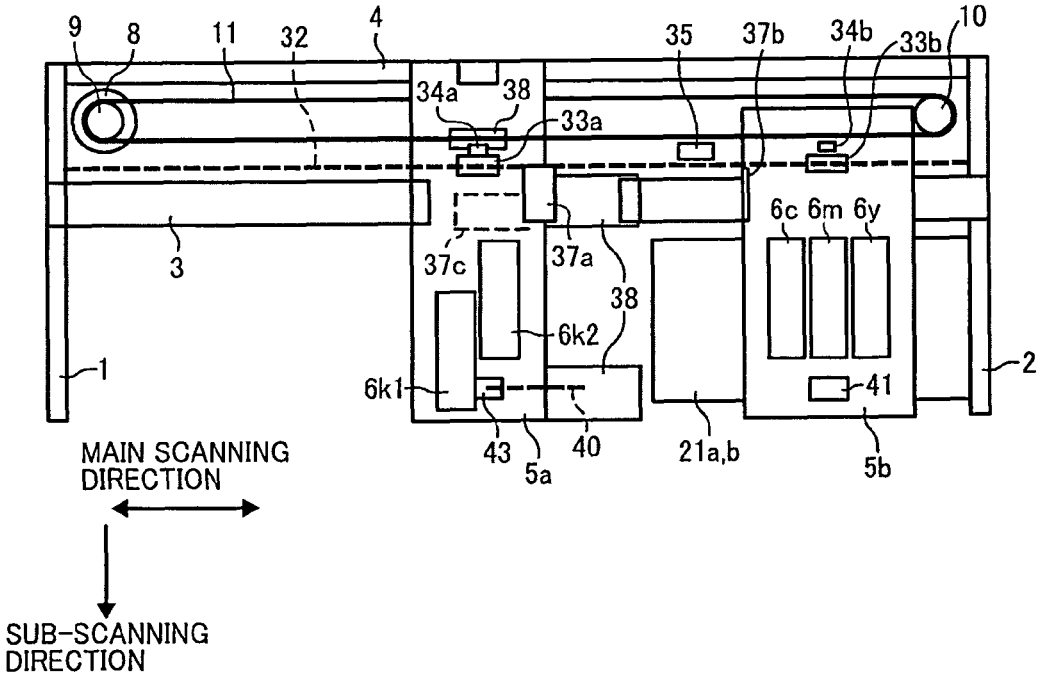
FIG. 9 is a schematic diagram illustrating another embodiment of the mechanism part of the image forming apparatus of the present disclosure.

FIG. 9 is a schematic structure view illustrating the mechanism portion of the ink jet recording apparatus.

In the ink jet recording apparatus illustrated in FIG. 9, in addition to the structure described for the first embodiment, a relative position encoder sheet (a second encoder sheet) 40 is provided to the first carriage 5*a*, and a third position detection sensor (encoder sensor) 41 is provided to the second carriage 5*b*.

The relative position encoder sheet 40 is held on a plate 39 by a supporting member 43 such that the relative position encoder sheet 40 is set substantially parallel to the guide rod 3.

The relative position encoder sheet 40 moves into the readable range of the third position detection sensor 41 when the first carriage 5*a* and the second carriage 5*b* are combined.

Therefore, by reading the relative position encoder sheet 40 by the third position detection sensor 41, the relative positions of the first carriage 5*a* and the second carriage 5*b* can be obtained.

Although the case in which the first carriage 5*a* has the relative position encoder sheet 40 and the second carriage 5*b* has the third position detection sensor 41 is described in this embodiment, the reversed embodiment in which the first carriage 5*a* has the third position detection sensor 41 and the second carriage 5*b* has the relative position encoder sheet 40 is also suitable considering that the objective of the structure is to detect the relative position of one of the two carriages to the other.

Figure 10:
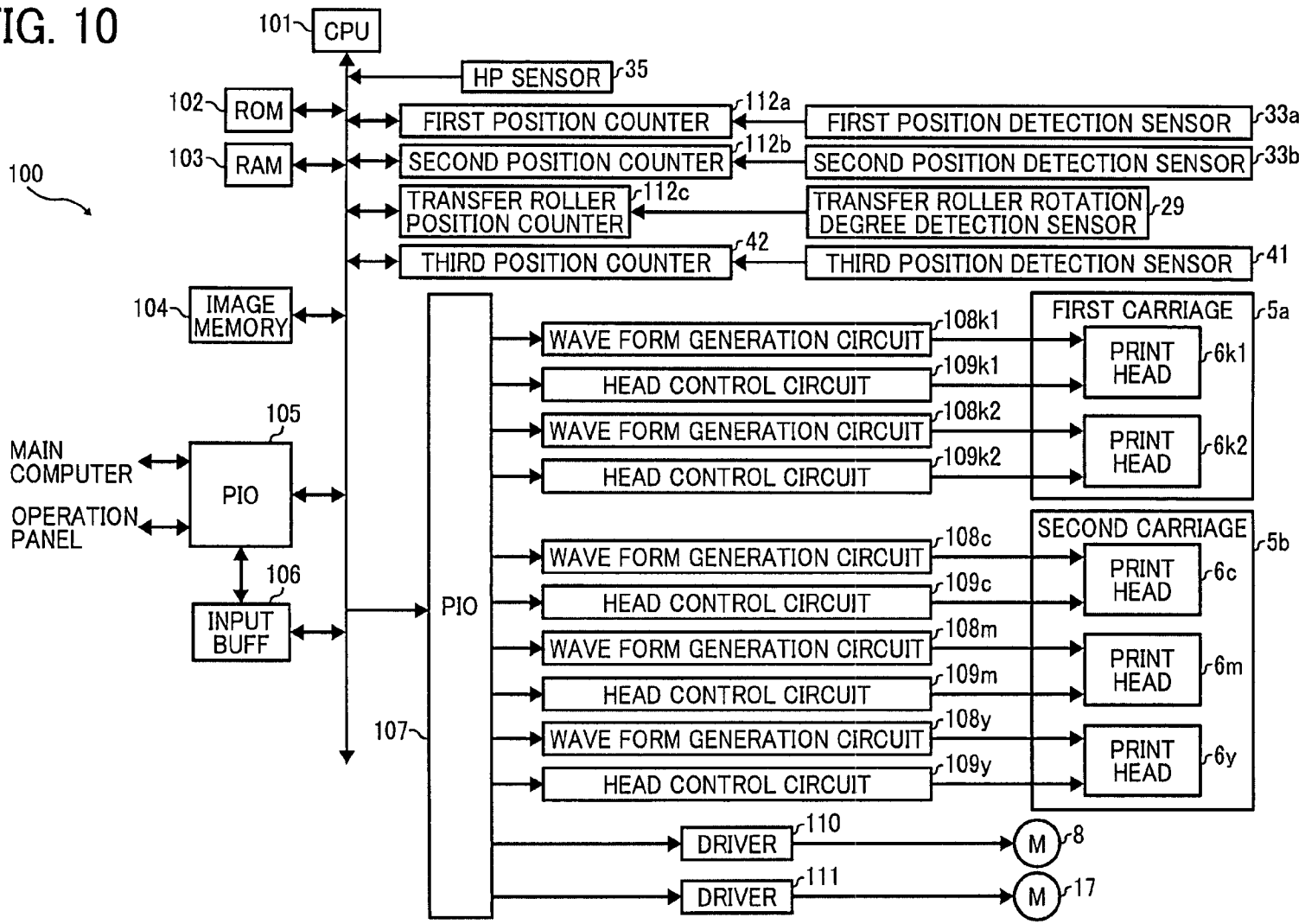
FIG. 10 in is a function block diagram of a control unit of another embodiment of the image forming apparatus of the present disclosure.

In addition, FIG. 10 is a function block diagram illustrating a control system (control unit) 100 of the image forming apparatus of this embodiment.

In the diagram illustrated in FIG. 10, the CPU 101 processes the output as the reading result of the relative position encoder sheet 40 by the third position detection sensor 41 in addition to the control unit 100 illustrated in FIG. 3.

The third position sensor 42 has the same function as the first position counter 112*a*.

Image Formation Method

Figure 11:
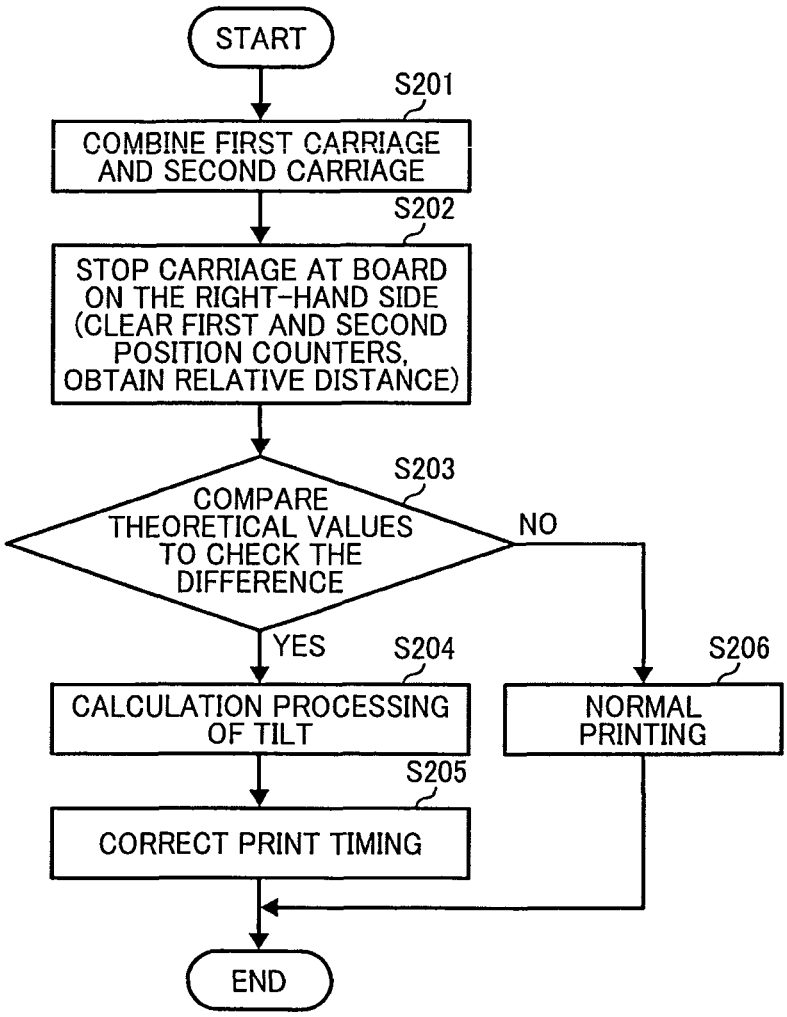
FIG. 11 is a flow chart of an example of the printing process.

An example of the color printing processing by the image forming apparatus related to this embodiment is described with reference to the flow chart illustrated in FIG. 11.

The overlapping description of the processing of the first and the second embodiments is also omitted.

First, the first carriage 5*a* and the second carriage 5*b* are coupled (S201).

Both carriages are coupled such that the first carriage 5*a* that has finished with the printing operation approaches at a low speed to the second carriage 5*b* which stands at the home position on the sub-system 21*b* followed by linking by a linking device 37 having a linking lever 37*a*, a linking mechanism receiver 37*b*, a linking driving mechanism 37*c*, etc.

Next, as described above, the counter values of the first position counter 112*a* and the second position counter 112*b* are reset in the state in which the combined first carriage 5*a* and the second carriage 5*b* are pressed against the side plate 2.

In addition, the relative distance "a" between the first carriage 5*a* and the second carriage 5*b* is obtained by reading the relative position encoder sheet 40 provided to the first carriage 5*a* by the third position detection sensor 41 provided to the second carriage 5*b* and stored in a RAM 103 (S202).

The misalignment occurs when both carriages are coupled (S201), and is not usually canceled even when both carriages are pressed against the right side plate 2.

There is no specific limit to the timing of obtaining the relative distance "a". For example, by obtaining the relative distance "a" at the home position immediately before the printing operation, printing position correction (S205) described later can be conducted based on the relative position just before the printing operation to improve the correction precision.

Next, whether there is a difference between the obtained relative distance "a" and the theoretical (=ideal) value A of the relative distance between the first carriage 5*a* and the second carriage 5*b* is determined by comparison (S203).

The theoretical value A can be obtained by, for example, the printed images (i.e., printed results), etc.

If there is a difference (Yes to S203), the tilt calculation processing (S204) described below is performed and printing adjustment is made based on this calculation result of the tilt calculation processing (S204) before actual printing.

On the other hand, if there is no difference, (No to S203), normal printing is performed (S206).

Tilting Calculation Processing

The tilt calculation processing (S204) to calculate the relative tilt of the carriages is described with reference to FIGS. 11 and 12.

Figure 12A:
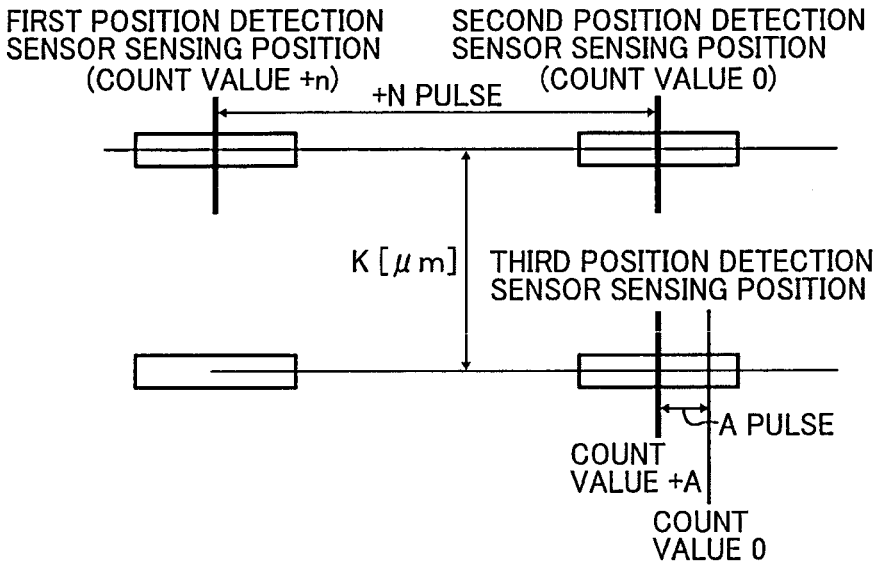
FIG. 12 is a diagram illustrating a process of calculating tilt.
Figure 12B:
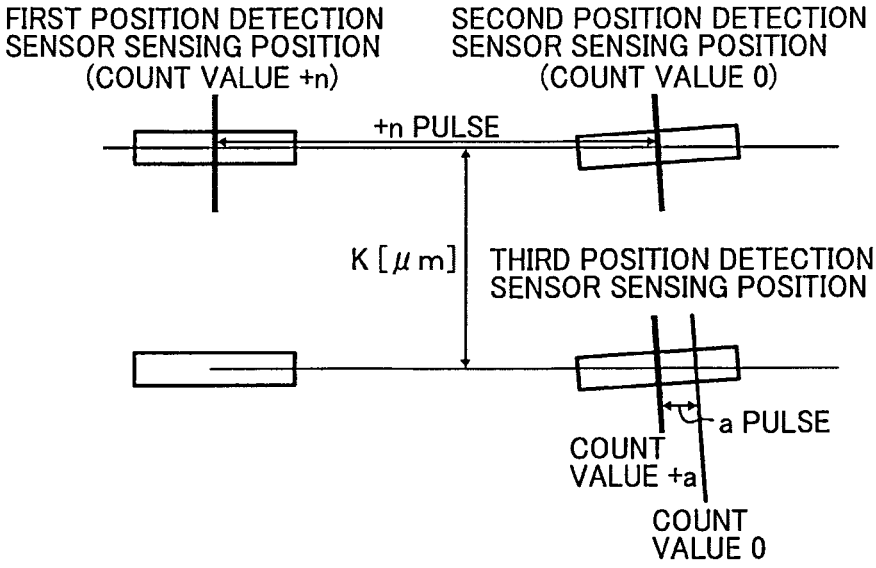

FIG. 12A is a diagram illustrating the positional relationship between the first position detection sensor 33*a* and the second position detection sensor 33*b* and the positional relationship between the relative position encoder sheet 40 and the third position detection sensor 41 when both carriages are at an ideal position at which three is no tilt relative to the scanning direction (direction perpendicular to the ink ejection direction). FIG. 12B is a diagram illustrating the positional relationship between the first position detection sensor 33*a* and the second position detection sensor 33*b* and the positional relationship between the relative position encoder sheet 40 and the third position detection sensor 41 when the second carriage 5*b* is misaligned relative to the scanning direction.

As illustrated in FIG. 12A, the number of pulses between the sensing position of the first position detection sensor 33*a* and the sensing position of the second position detection sensor 33*b* installed onto the coupled carriages is N pulses as ideal.

In addition, the sensed value (count value) by the third position detection sensor 41 is A pulse as ideal from zero count value of the relative position encoder sheet 40.

The distance between the encoder sheet 32 and the relative position encoder sheet 40 is defined as K (μm).

However, when the second carriage 5*b* is misaligned as illustrated in FIG. 12B, the number of pulses between the sensing position of the first position detection sensor 33*a* and the sensing position of the second position detection sensor 33*b* is, for example, +n (n<N) in some cases.

In addition, the sensed value (count value) by the third position detection sensor 41 is, for example, +a (a>A) from zero count value of the relative position encoder sheet 40 in some cases.

Therefore, the variation of the pulse caused by the misalignment between the sensing position of the first position detection sensor 33*a* and the sensing position of the second position detection sensor 33*b* is represented as $|N-n|$ by the number of pulses +N at the ideal relationship and the number of pulses +n when the second carriage 5*b* is misaligned.

Similarly, the variation of the pulse caused by the misalignment at the sensing position by the third position detection sensor 41 is represented as $|A-a|$ by the number of pulses A at the ideal relationship and the number of pulses +a when the second carriage 5*b* is misaligned.

Figure 13:
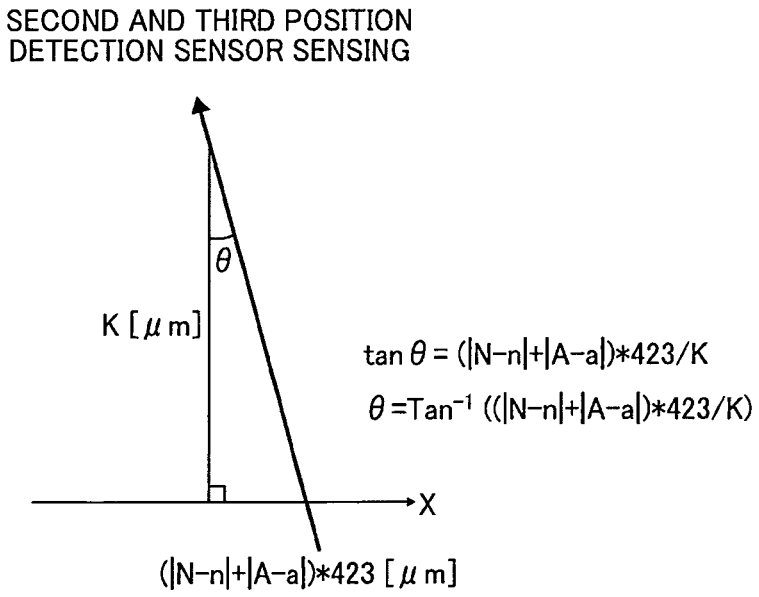
FIG. 13 is another diagram illustrating a process of calculating tilt.

Thus, as illustrated in FIG. 13, the variation of the pulse in the X direction at the relative position encoder sheet caused by tilt of the sensing position direction of the second position detection sensor 33*b* and the third position detection sensor 41 is represented by $(|N-n|+|A-a|)$.

If the encoder resolution power is 42.3 (μm), the variance distance in the X direction is represented by (|N−n|+|A−a|)× 42.3 (μm).

The relative tilt angle θ of the second carriage 5*b* to the first carriage 5*a* is represented by the following Relationship (2) according to the Relationship (1):

$$\tan\theta = |N-n|+|A-a|\times 42.3/K \qquad \text{Relationship (1)}$$

$$\theta = \tan^{-1}(|N-n|+|A-a|)\times 42.3/K \qquad \text{Relationship (2)}$$

By using the thus calculated relative tilt angle θ, degradation of the printed image caused by the variance of the linking accuracy of both carriages at the home position when the carriages are separated can be prevented by correction of the printing position by the ink ejection timing (S206).

There is no limit to the selection of the correction method of the printing position. For example, the printing position can be corrected by shifting the image data for corresponding nozzle by nozzle from the obtained θ based on the nozzle situated at the end on the second position detection sensor 33*b* with regard to the main scanning direction, and changing the position of the image ejected by the nozzles (for example, making the image data corresponding to the nozzle position in the case of tilt by interpolation) with regard to the sub-scanning direction.

According to the image forming apparatus related to the second embodiment, the relative position of each carriage when the first carriage 5*a* and the second carriage 5*b* are coupled can be detected.

In addition, based on the values detected by the first, second and third position detection sensors, and the ideal value obtained by images, etc., the relative tilt angle of the first carriage and the second carriage can be calculated.

Furthermore, based on the obtained relative tilt angle, the variance in printing can be corrected.

Although the first carriage 5*a* has a recording head that ejects black ink, and the second carriage 5*b* has color recording heads that eject color ink in the embodiments described above, another embodiment is also suitable in which both of the first carriage 5*a* and the second carriage 5*b* eject color ink, or black ink.

This document claims priority and contains subject matter related to Japanese Patent Application no. 2009-266332, and 2010-095941, filed on Nov. 24, 2009, and Apr. 19, 2010, respectively, the entire contents of which are hereby incorporated herein by reference.

According to the present invention, the image quality is improved by reducing the occurrence of print position shift between the print position when the first carriage is singly scanned, and the print position when the first carriage and the second carriage are integrally scanned, which is ascribable to the misalignment of the first carriage and the second carriage when they are coupled.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

a first carriage comprising a print head independently movable in a main scanning direction;

a second carriage comprising a print head integrally movable in the main scanning direction together with the first carriage;

an encoder sheet useable in detecting positions of the first carriage and the second carriage in the main scanning direction;

a first home position reference unit associated with the first carriage;

a second home position reference unit associated with the second carriage;

a home position detector configured to detect the first home position reference unit and the second home position reference unit;

a first position detector associated with the first carriage, and configured to detect a position of the first carriage by reading the encoder sheet;

a second position detector associated with the second carriage, and configured to detect a position of the second carriage by reading the encoder sheet; and a control unit comprising a central processing unit, configured to control ejection of ink from the print head of the first carriage based on an output from the first position detector when the home position detector detects the first home position reference unit, and to control ejection of ink from the print head of the second carriage based on an output from the second position detector when the home position detector detects the second home position reference unit, wherein one of the first carriage and the second carriage further comprises a relative position encoder sheet, useable in detecting a position in the main scanning direction, and the other of the first carriage and the second carriage further comprises a third position detector configured to detect relative positions of the first carriage and the second carriage by reading the relative position encoder sheet, and wherein a relative tilt between the first carriage and the second carriage is detected based on outputs of the first position detector, the second position detector, and the third position detector.

2. The image forming apparatus according to claim 1, wherein when images are printed by moving the first carriage, the first carriage and the second carriage are coupled together and pressed against a stopper provided on a lateral side of the apparatus until outputs of the first position detector and the second position detector are unchanged, and thereafter the outputs of the first position detector and the second position detector are reset, the first carriage is moved to a printable area, and a printing position of the first carriage is initialized when the home position detector detects the first home position reference unit.

3. The image forming apparatus according to claim 1, wherein when images are printed by integrally moving the first carriage and the second carriage together, the first carriage and the second carriage are coupled together and pressed against a stopper provided on a lateral side of the apparatus until outputs of the first position detector and the second position detector are unchanged, thereafter the outputs of the first position detector and the second position detector are reset, the first carriage and the second carriage are together moved to a printable area, a printing position of the first carriage is initialized when the home position detector detects the first home position reference unit, and a printing position of the second carriage is initialized when the home position detector detects the second home position reference unit.

4. The image forming apparatus according to claim 1, wherein printing positions are corrected based on the relative tilt between the first carriage and the second carriage.

5. The image forming apparatus according to claim 1, wherein the first carriage and the second carriage are coupled and separated by a lock mechanism.

6. An image formation method comprising:

moving a first carriage comprising a print head in a main scanning direction;

moving a second carriage comprising a print head integrally in the main scanning direction together with the first carriage;

detecting positions of the first carriage and the second carriage in the main scanning direction by reading an encoder sheet by a first position detector associated with the first carriage, and a second position detector associated with the second carriage, respectively;

detecting a first home position reference unit associated with the first carriage and a second home position reference unit associated with the second carriage by a home position detector;

controlling ejection of ink from the print head of the first carriage based on an output from the first position detector when the home position detector detects the first home position reference unit and ejection of ink from the print head of the second carriage based on an output from the second position detector when the home position detector detects the second home position reference unit by control unit comprising a central processing unit;

detecting a position in the main scanning direction by reading a relative position encoder sheet of one of the first carriage and the second carriage;

detecting relative positions of the first carriage and the second carriage by reading, by a third position detector of the other of the first carriage and the second carriage, the relative position encoder sheet; and determining a relative tilt between the first carriage and the second carriage based on outputs of the first position detector, the second position detector, and the third position detector.

7. The image formation method according to claim 6, wherein printing positions are corrected based on the relative tilt between the first carriage and the second carriage.

8. The image formation method according to claim 6, wherein the first carriage and the second carriage are coupled and separated by a lock mechanism.

9. A non-transitory computer-readable recording medium storing a computer program for executing a control method for a recording device, the control method comprising:

moving a first carriage comprising a print head in a main scanning direction;

moving a second carriage comprising a print head integrally in the main scanning direction together with the first carriage;

detecting positions of the first carriage and the second carriage in the main scanning direction by reading an encoder sheet by a first position detector associated with the first carriage, and a second position detector associated with the second carriage, respectively;

detecting a first home position reference unit associated with the first carriage and a second home position reference unit associated with the second carriage by a home position detector;

controlling ejection of ink from the print head of the first carriage based on an output from the first position detector when the home position detector detects the first home position reference unit and ejection of ink from the print head of the second carriage based on an output from the second position detector when the home position detector detects the second home position reference unit by control unit comprising a central processing unit;

detecting a position in the main scanning direction by reading a relative position encoder sheet of one of the first carriage and the second carriage;

detecting relative positions of the first carriage and the second carriage by reading, by a third position detector of the other of the first carriage and the second carriage, the relative position encoder sheet; and determining a relative tilt between the first carriage and the second carriage based on outputs of the first position detector, the second position detector, and the third position detector.

10. A non-transitory computer-readable recording medium according to claim 9, wherein printing positions are corrected based on the relative tilt between the first carriage and the second carriage.

11. A non-transitory computer-readable recording medium according to claim 9, wherein the first carriage and the second carriage are coupled and separated by a lock mechanism.

* * * * *